US008203061B2

(12) United States Patent
Markakis

(10) Patent No.: US 8,203,061 B2
(45) Date of Patent: Jun. 19, 2012

(54) V TYPE ELECTRIC GUITAR FOOTREST

(76) Inventor: Konstantinos Markakis, Pefki Attikis (GR)

( * ) Notice: Subject to any disclaimer, the term of this patent is extended or adjusted under 35 U.S.C. 154(b) by 93 days.

(21) Appl. No.: 12/528,569

(22) PCT Filed: Jan. 29, 2008

(86) PCT No.: PCT/GR2008/000007

§ 371 (c)(1),
(2), (4) Date: Aug. 25, 2009

(87) PCT Pub. No.: WO2008/104813

PCT Pub. Date: Sep. 4, 2008

(65) Prior Publication Data

US 2010/0313731 A1 Dec. 16, 2010

(30) Foreign Application Priority Data

Feb. 26, 2007 (GR) ..... 20070100125

(51) Int. Cl.
*G10D 3/00* (2006.01)

(52) U.S. Cl. ..... 84/327; 84/421

(58) Field of Classification Search ..... 84/327, 84/421, 453

See application file for complete search history.

(56) References Cited

U.S. PATENT DOCUMENTS

| | | | | |
|---|---|---|---|---|
| 4,966,062 | A * | 10/1990 | Driggers et al. | 84/327 |
| 5,616,874 | A * | 4/1997 | Kraus et al. | 84/327 |
| 6,252,150 | B1 * | 6/2001 | Johnson | 84/327 |
| 2008/0196572 | A1 * | 8/2008 | Navarro | 84/327 |

FOREIGN PATENT DOCUMENTS

| | | |
|---|---|---|
| AT | 309 | 7/1995 |
| DE | 20300431 | 3/2003 |
| DE | 20118021 | 1/2004 |
| GB | 2316525 | 2/1998 |

* cited by examiner

*Primary Examiner* — Jianchun Qin

(74) *Attorney, Agent, or Firm* — Sughrue Mion, PLLC

(57) ABSTRACT

The V type electric guitar footrest (2) which is attached to the lower part of the input socket device (5) consists of an L-sectioned, half triangular component (1) on the lower edge of the V type electric guitar and a triangular stabilizing backrest (3) that is attached to the rear side of the half triangular component (1). An alternative way of stabilizing the V type electric guitar inside the footrest is to attach a pair of retaining straps (4) on the rear side of the L-sectioned, half triangular component (1). A second alternative way of stabilizing the V type electric guitar inside the footrest (without having to use a stabilizing triangular part nor any retaining straps) is to use a U-sectioned (Ia) instead of an L-sectioned half triangular component (1), like the one mentioned in the first application method. In all three application methods of this invention, there is the possibility of adjusting the position of the curved supporting base (2) along the input socket device (5), so that the best possible adjustment for the positioning of the guitar on the guitarist's/user's foot is achieved. This footrest allows the guitarist/user to hold the V type electric guitar like any other regular guitar (when the guitar is used in a sitting position) and to play without getting tired, resulting in a prolonged time of practice/use, in other words in a more efficient performance and ultimate pleasure.

6 Claims, 9 Drawing Sheets

V TYPE ELECTRIC GUITAR FOOTREST

The present application is the U.S. National Phase of International Patent Application No. PCT/GR2008/000007, filed on Jan. 28, 2008, which claims the benefit of Greek Patent Application No. 20070100125, filed on Feb. 26, 2007.

This invention refers to a footrest designed for V type electric guitars which consists of a curved supporting base and an input socket device. This type of input socket device consists of a half triangular, L-sectioned socket component (with an interior soft lining for the instrument's own protection) on the lower part of the electric guitar and a stabilizing triangular part (backrest) of the V type electric guitar in the inner part of the footrest. An alternative way of stabilizing the V type electric guitar inside the footrest is to attach a pair of retaining straps on the rear side of the half triangular component. A second alternative way of stabilizing the V type electric guitar inside the footrest (without having to use the triangular stabilizing part nor any retaining straps) would be to use a U-sectioned triangular component (with an interior soft lining for the instrument's own protection) instead of the L-sectioned component that was mentioned in the first application method. In all three cases, the input device is based on a curved supporting base in order to be perfectly fitted on the guitarist's/user's foot.

No other similar footrest has ever been manufactured before.

The advantage of this patent is that the guitarist/user doesn't have to hold the guitar in between his legs, while playing the guitar in a sitting position; instead, he can hold it like any other regular guitar.

This footrest allows the guitarist/user to hold the guitar on a horizontal position, rather than on an inclined position, which is the common position provided by the way the electric guitar is originally manufactured.

A simple way of implementing the V type electric guitar footrest is to use an L-sectioned half triangular input component, as a socket device (with interior soft lining for the instrument's own protection) on the lower part of the V type electric guitar as well as a triangular part (serving as a supporting back) for the stabilization of the V type electric guitar inside the footrest.

A second alternative way of stabilizing the V type electric guitar inside the L-sectioned, half triangular input socket component is to attach retaining straps on the rear side of the half triangular component instead of the component's backrest mentioned in the application method described above.

A second alternative way of stabilizing the V type electric guitar inside the footrest (without having to use the stabilizing triangular part nor any restraining straps) would be to use a U-sectioned (with an interior soft lining for the instrument's own protection) instead of an L-sectioned half triangular component, like the one described in the two previous application methods.

In all three cases, the curved supporting base that can be adjusted beneath the input socket device, has the ability to move freely along one side of the half triangular component, either L- or U-sectioned respectively, so that the position of the guitar can be adjusted in the best possible way on the guitarist's/user's foot.

As it is proven by the invention's proper use, the guitarist does no longer need to place the electric guitar in between his legs. Now, the guitar is supported by means of the footrest on the guitarist's right foot for right-handed guitarists or, accordingly, on the left foot for left-handed guitarists.

This makes the process of using the guitar so much easier when the guitarist plays in a sitting position, because the hand by which he plays the strings remains unweary (left hand for right-handed guitarists and right for left-handed guitarists respectively), because it is now positioned parallel to his/her body.

The invention's technical specifications allow the half triangular component, according to the electric guitar type that it has been originally designed for, to have a different inner formatted shape in order to be properly adjusted to the lower edge of each and every V type electric guitar.

Figure 1:
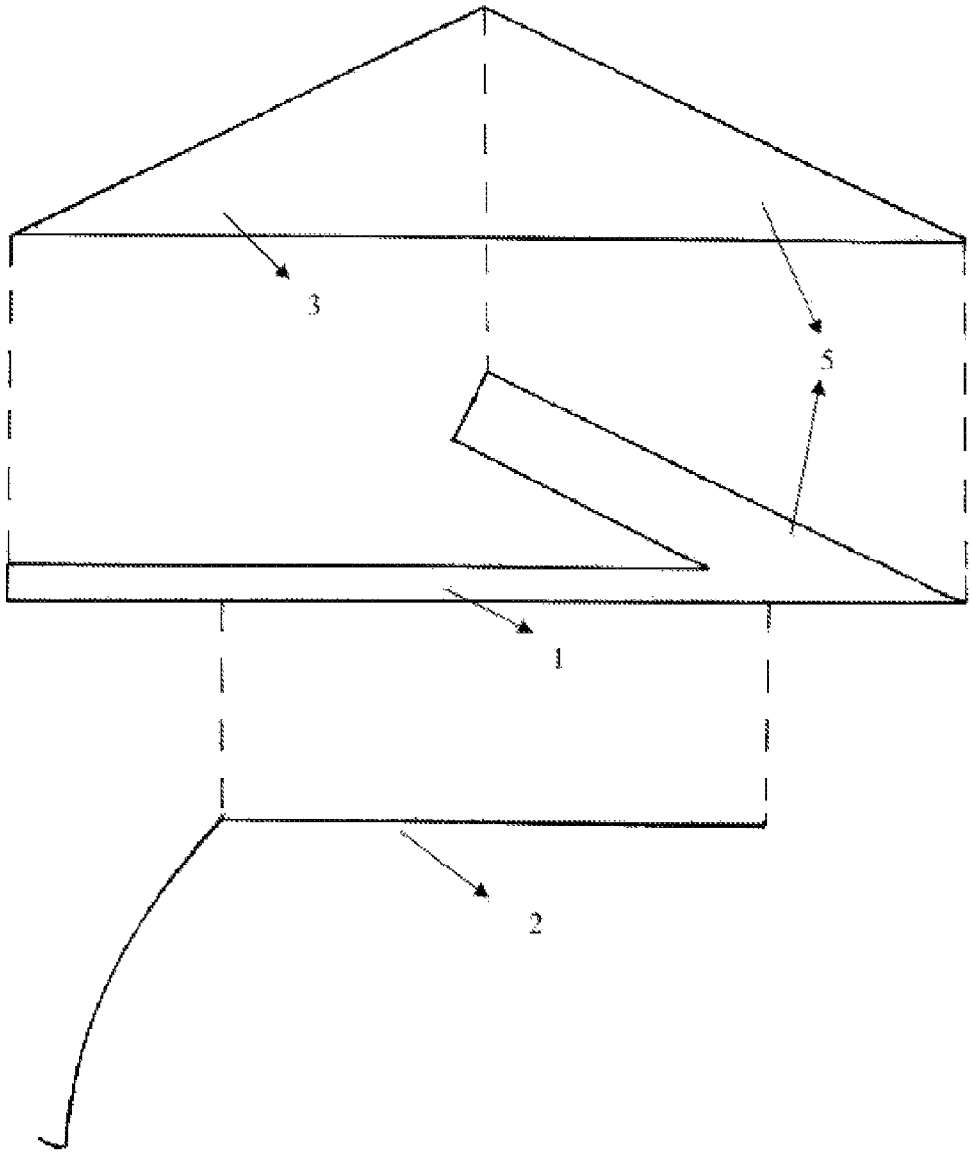
FIG. 1 shows a view of the V type electric guitar footrest, where the input socket device (5) (i.e. the L-sectioned half triangular component (1) and the triangular part (3)) and the curved supporting base (2) are front view illustrated.
Figure 2:
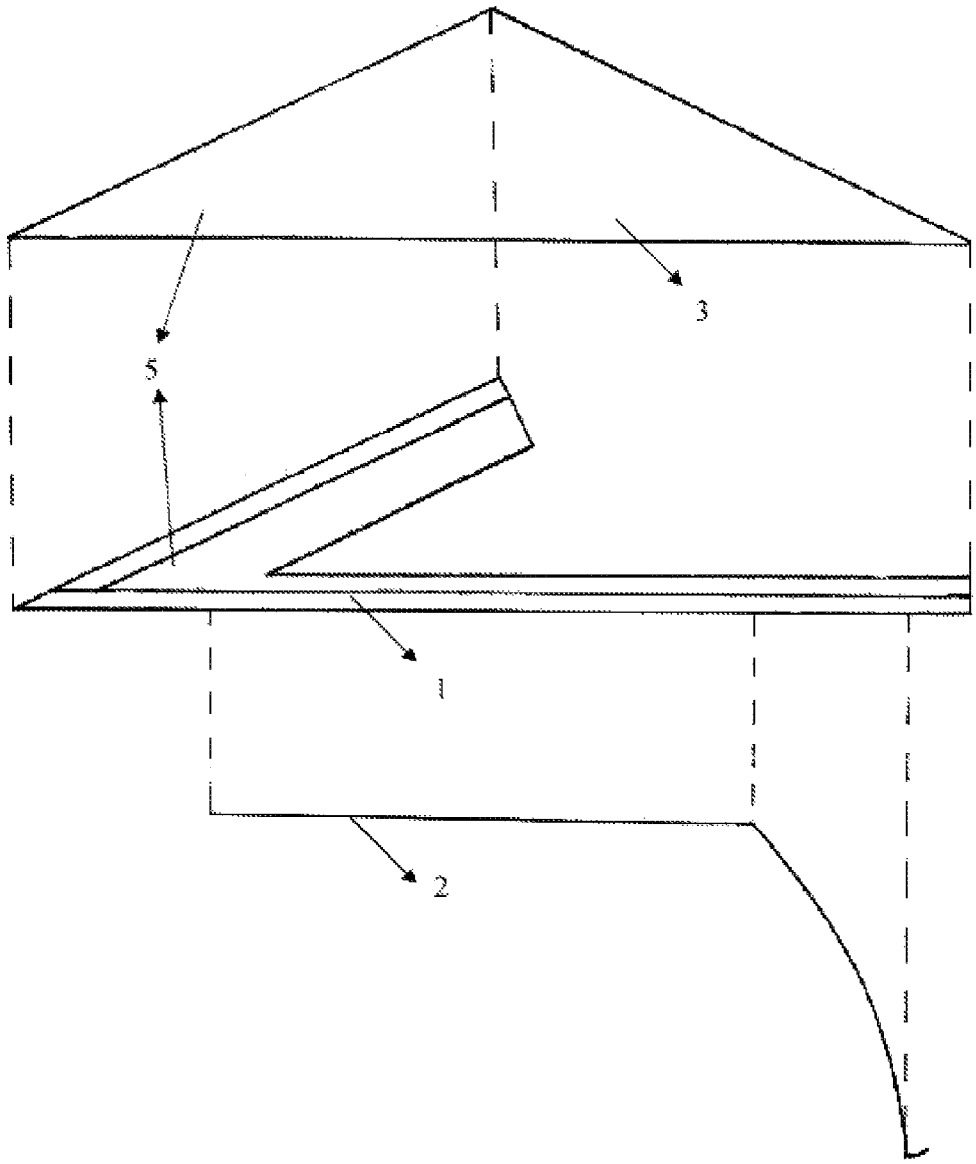
FIG. 2 shows one of the V type electric guitar views, where the input socket device (5) (i.e. the L-sectioned half triangular component (1) and the triangular part (3)) and the curved supporting base (2) are rear view illustrated.
Figure 3:
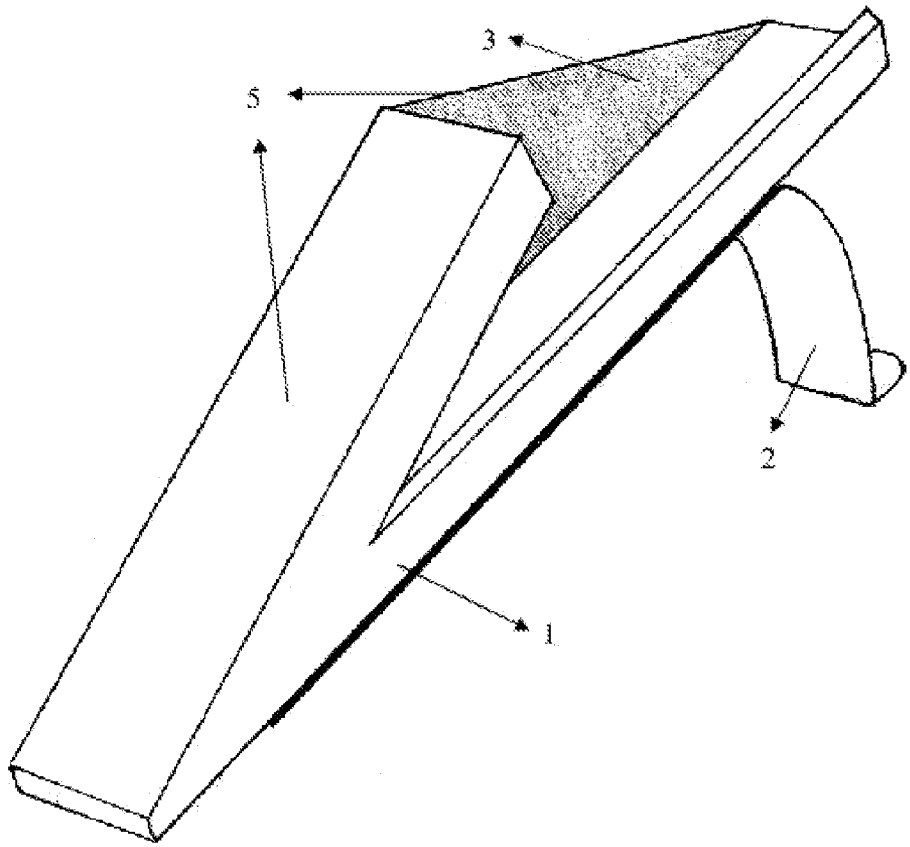
FIGS. 3 and 4 show a perspective front view of the V type electric guitar footrest from two different viewing angles.
Figure 4:
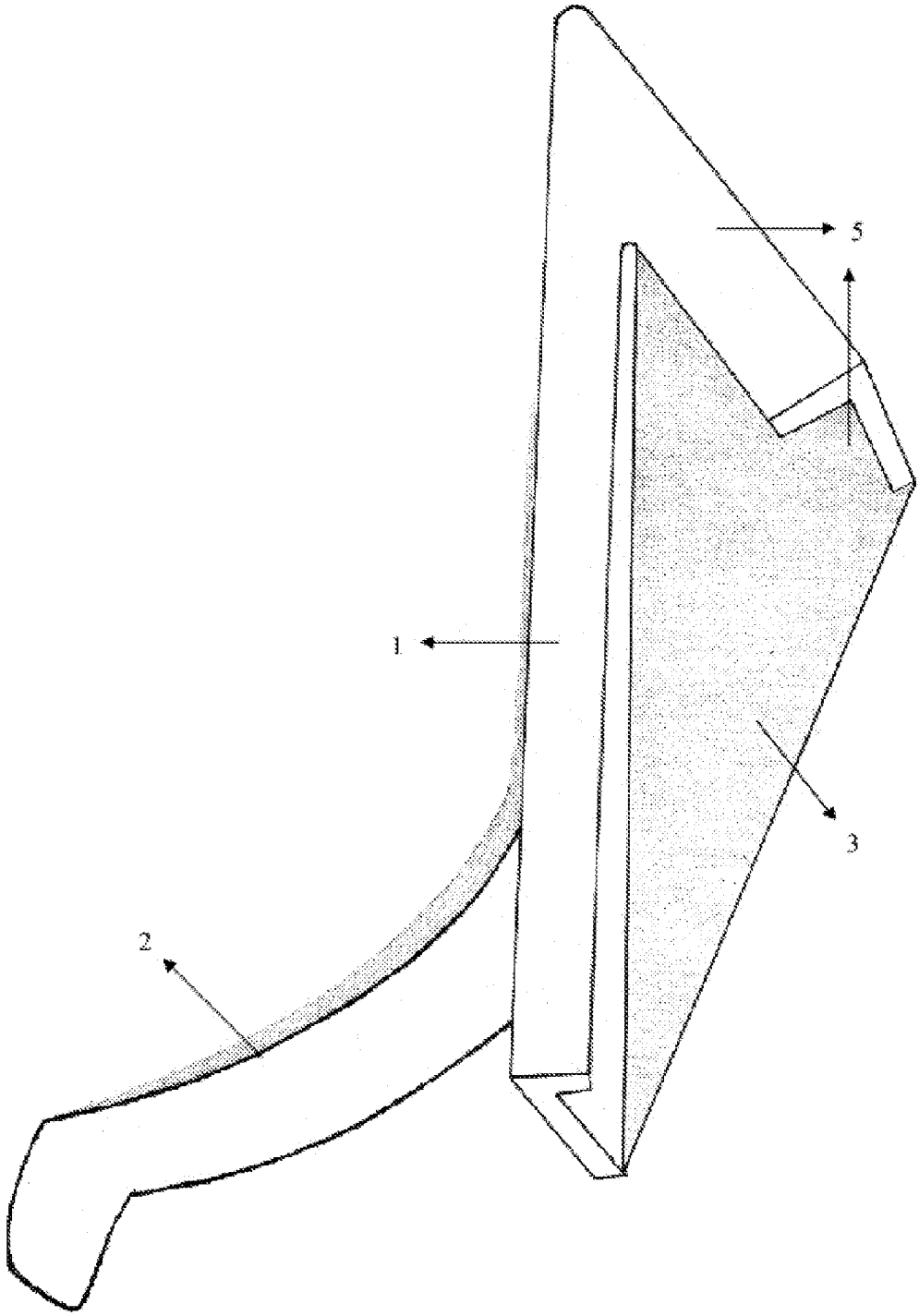
Figure 5:
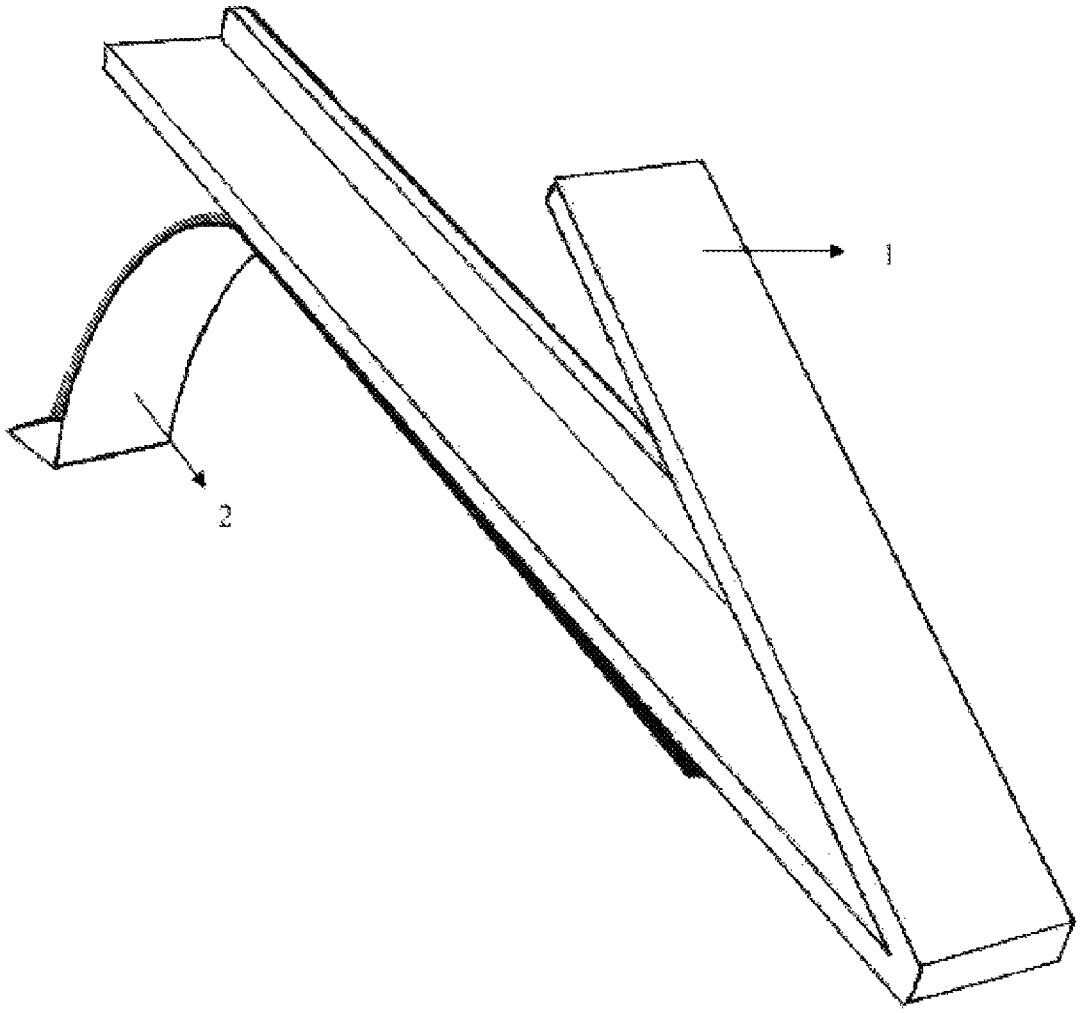
FIG. 5 shows a perspective rear view of the V type electric guitar footrest without the triangular part (3) for better viewing of the L-sectioned half triangular component (1) inner part.
Figure 6:
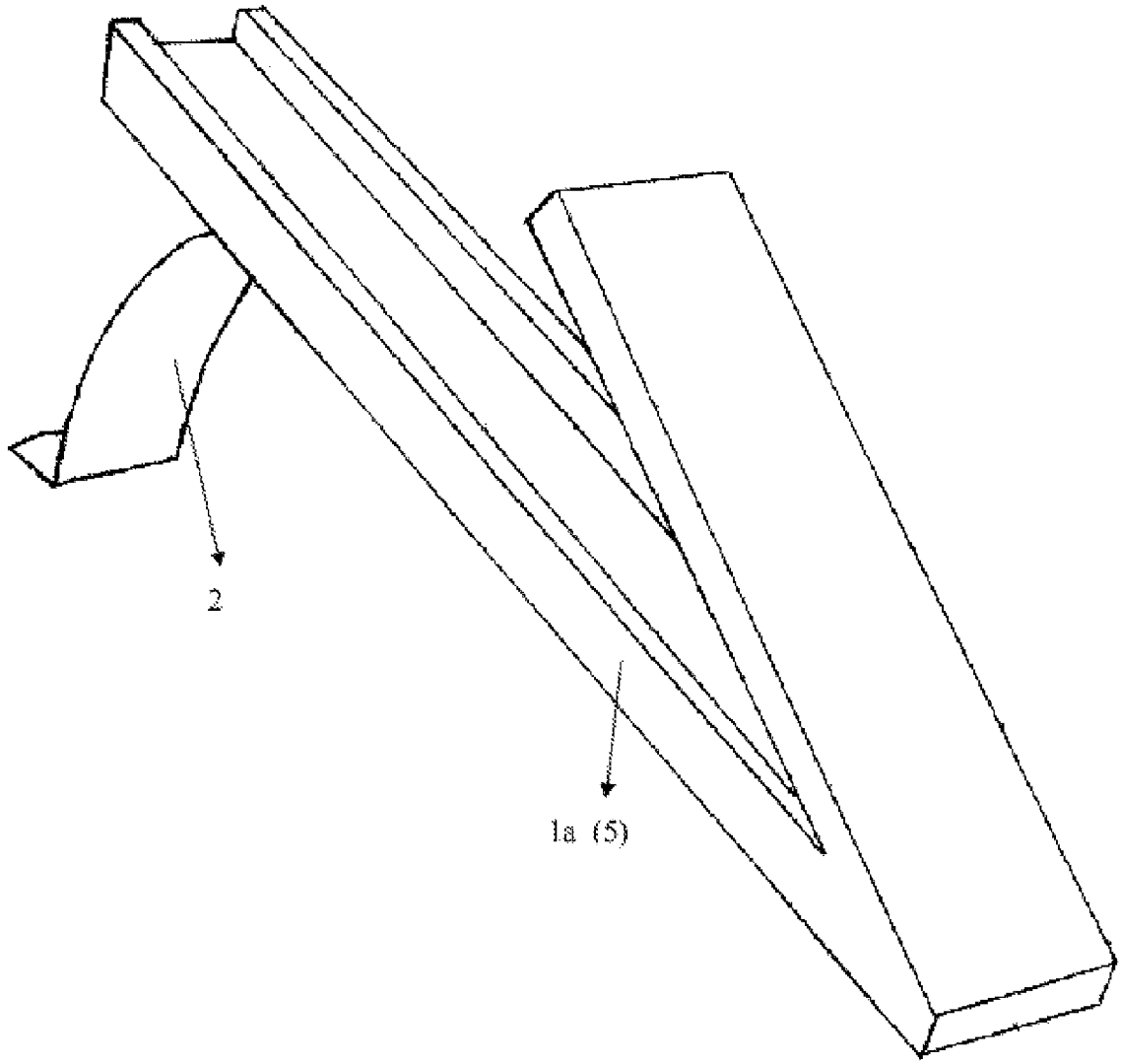
FIG. 6 shows a V type electric guitar footrest view, where the input socket device (5) (i.e. the U-sectioned half triangular component (1*a*)) and the curved supporting base (2) are rear view illustrated.
Figure 7:
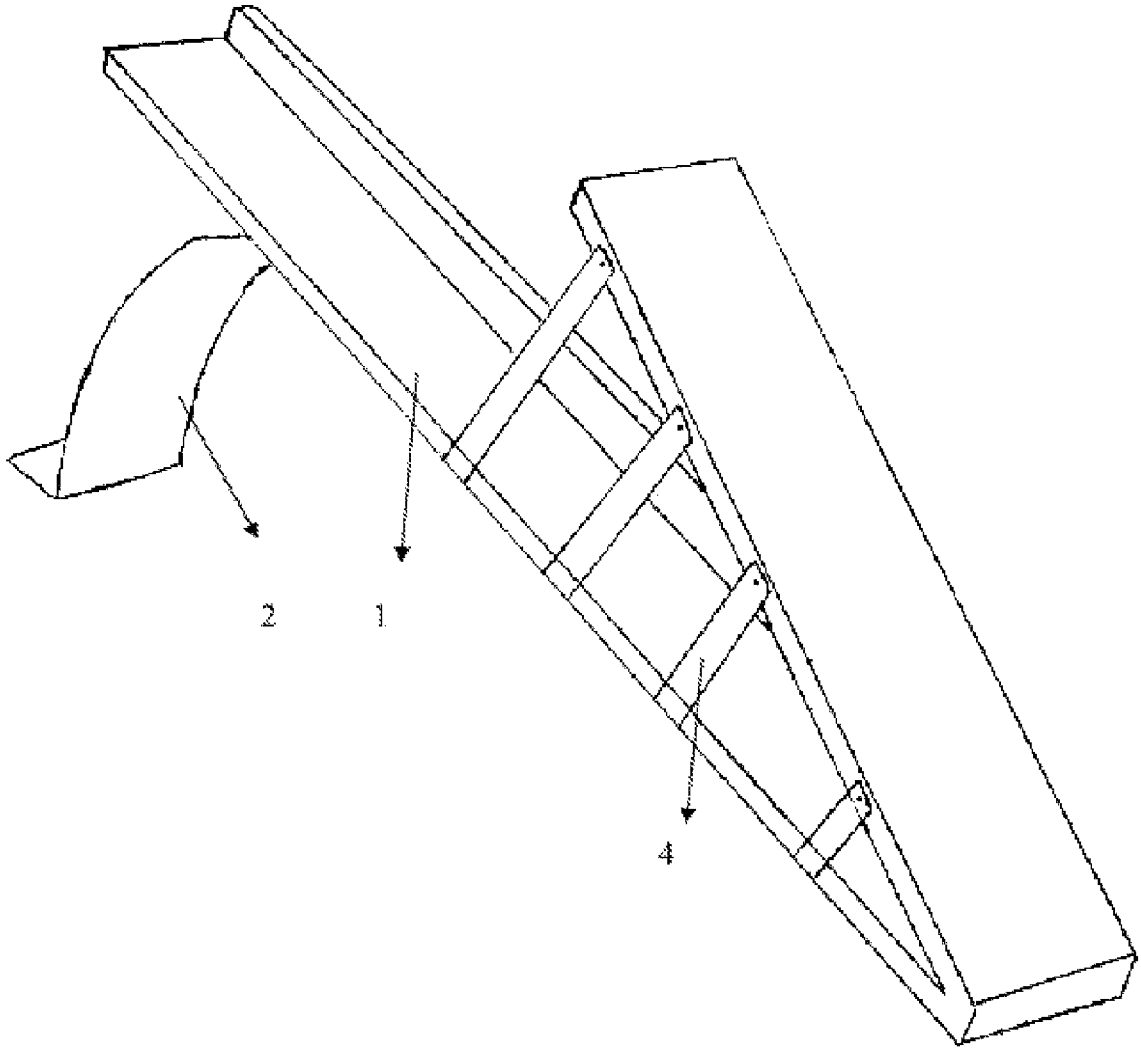
FIG. 7 shows a V type electric guitar footrest view, where the input socket device (5) (i.e. the L-sectioned half triangular component (1) and the retaining straps (4)) and the curved supporting base (2) are rear view illustrated.
Figure 8:
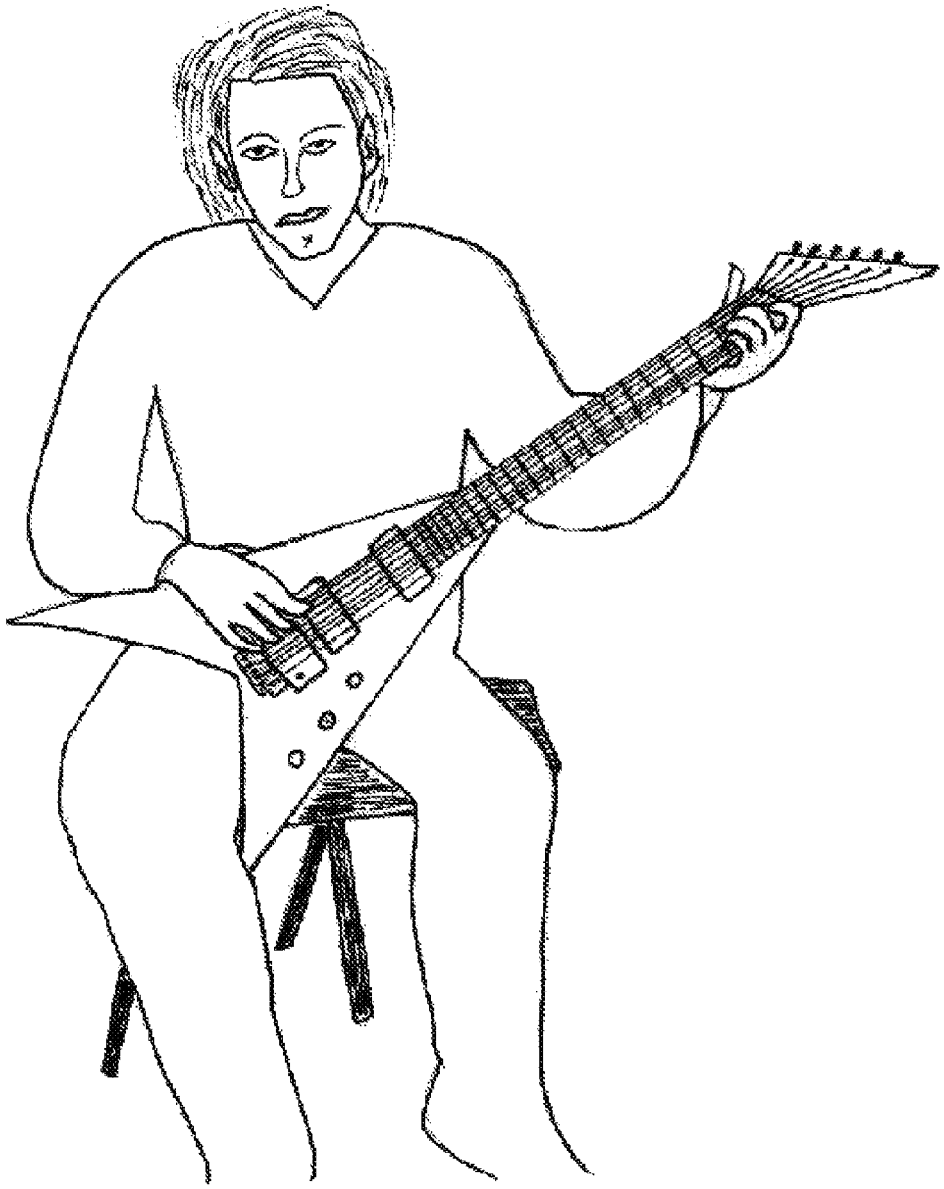
FIG. 8 illustrates the way the guitarist/user positions the V type guitar without using the footrest.
Figure 9:
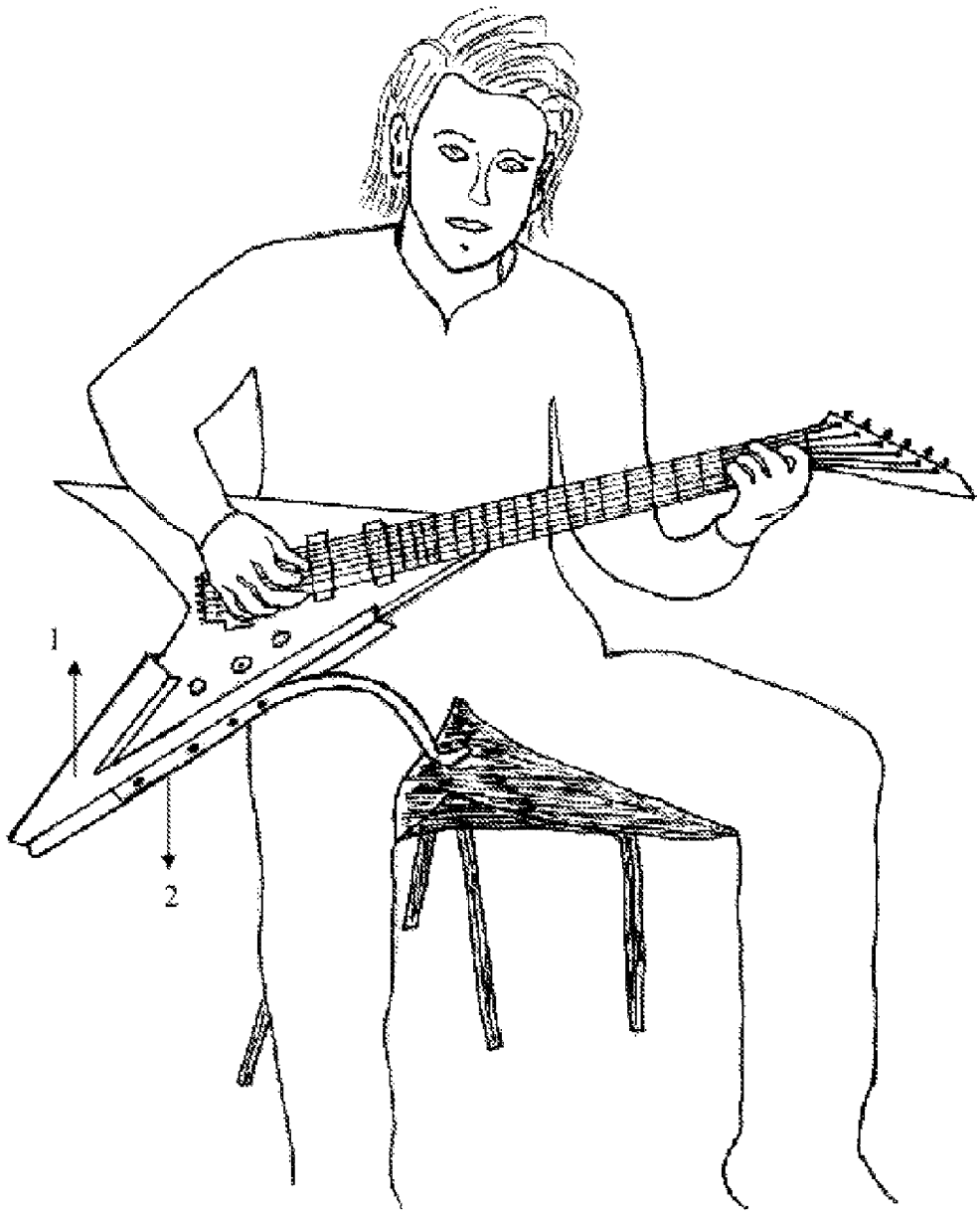
FIG. 9 illustrates the way the guitarist/user positions the V type guitar using the footrest.

An application method of this invention is described with reference to FIGS. 1-9.

The V type electric guitar footrest consists of an input socket device (5) and a curved supporting base (2) that is adjusted to the lower part of the socket device (5). The input socket device (5) consists of an L-sectioned, half triangular socket component (1) for receiving the lower part of the V type electric guitar (with soft interior lining for the instrument's own protection) and a triangular part (3) (with soft lining) that is adjusted on the rear side of the L-sectioned, half triangular component (1).

An alternative way of stabilizing the V type electric guitar inside the footrest is to attach retaining straps (4) on the rear side of the L-sectioned half triangular component (1).

A second alternative way of stabilizing the V type electric guitar inside the footrest (without having to use a stabilizing triangular part nor any retaining straps) is to use a U-sectioned instead of the L-sectioned half triangular component mentioned in the first application method.

The inner angle as well as the form of the half triangular internal cavity (1), (1*a*) (L- and U-sectioned respectively) are directly determined by the V type electric guitar model for which the footrest has been originally designed. The curved supporting base (2) is shaped in a way that it can be perfectly fitted on the guitarists's/user's foot and, in addition to this, in order to help positioning the guitar in a proper manner (by means of the input socket device (5)) with regard to the guitarist's body.

The invention claimed is:

1. A V type electric guitar footrest, consisting of a curved supporting base of the V type guitar on the guitarist's/user's thigh and an input socket device of the V type electric guitar, connected to the curved supporting base, where the aforementioned footrest is characterized by the fact that the input socket device of the V type electric guitar is composed of a half triangular, two-sided component, whose upper part interior surface is adjusted to the upper surface of the lower edge of the electric guitar, while the lower part interior surface is adjusted to the lower surface of the lower edge of the electric guitar, resulting in boxing the lower edge of the guitar inside the footrest, wherein the half triangular component is L-sectioned and has a triangular stabilizing backrest adjusted on its rear side, so that the lower edge of the guitar can remain stable inside the L-sectioned, half triangular component.

2. The V type electric guitar footrest in accordance with claim 1, wherein the curved supporting base is adjustable in different positions along the lower part of the half triangular component, which is L-sectioned.

3. A V type electric guitar footrest, consisting of a curved supporting base of the V type guitar on the guitarist's/user's thigh and an input socket device of the V type electric guitar, connected to the curved supporting base, where the aforementioned footrest is characterized by the fact that the input socket device of the V type electric guitar is composed of a half triangular, two-sided component, whose upper part interior surface is adjusted to the upper surface of the lower edge of the electric guitar, while the lower part interior surface is adjusted to the lower surface of the lower edge of the electric guitar, resulting in boxing the lower edge of the guitar inside the footrest, wherein the half triangular component is L-sectioned and has a pair of retaining straps attached on its rear side, so that the lower edge of the guitar can remain stable inside the L-sectioned, half triangular component.

4. The V type electric guitar footrest in accordance with claim 3, wherein the curved supporting base is adjustable in different positions along the lower part of the half triangular component, which is L-sectioned.

5. A V type electric guitar footrest, consisting of a curved supporting base of the V type guitar on the guitarist's/user's thigh and an input socket device of the V type electric guitar, connected to the curved supporting base, where the aforementioned footrest is characterized by the fact that the input socket device of the V type electric guitar is composed of a half triangular, two-sided component, whose upper part interior surface is adjusted to the upper surface of the lower edge of the electric guitar, while the lower part interior surface is adjusted to the lower surface of the lower edge of the electric guitar, resulting in boxing the lower edge of the guitar inside the footrest, wherein the angle formed by the two sides of the half triangular component as well as its internal cavity are directly dependent on the V type electric guitar model for which it is originally intended, wherein the half triangular component is L-sectioned and has a triangular stabilizing backrest adjusted on its rear side, so that the lower edge of the guitar can remain stable inside the L-sectioned, half triangular component.

6. A V type electric guitar footrest, consisting of a curved supporting base of the V type guitar on the guitarist's/user's thigh and an input socket device of the V type electric guitar, connected to the curved supporting base, where the aforementioned footrest is characterized by the fact that the input socket device of the V type electric guitar is composed of a half triangular, two-sided component, whose upper part interior surface is adjusted to the upper surface of the lower edge of the electric guitar, while the lower part interior surface is adjusted to the lower surface of the lower edge of the electric guitar, resulting in boxing the lower edge of the guitar inside the footrest, wherein the angle formed by the two sides of the half triangular component as well as its internal cavity are directly dependent on the V type electric guitar model for which it is originally intended, wherein the half triangular component is L-sectioned and has a pair of retaining straps attached on its rear side, so that the lower edge of the guitar can remain stable inside the L-sectioned, half triangular component.

* * * * *